United States Patent [19]

Euker, Jr. et al.

[11] 4,432,773

[45] Feb. 21, 1984

[54] FLUIDIZED BED CATALYTIC COAL GASIFICATION PROCESS

[76] Inventors: Charles A. Euker, Jr., 15163 Dianna La., Houston, Tex. 77062; Robert D. Wesselhoft, 120 Caldwell; John J. Dunkleman, 3704 Autumn La., both of Baytown, Tex. 77520; Dolores C. Aquino, 15142 McConn, Webster, Tex. 77598; Toby R. Gouker, 5413 Rocksprings Dr., LaPorte, Tex. 77571

[21] Appl. No.: 475,209

[22] Filed: Mar. 21, 1983

Related U.S. Application Data

[63] Continuation of Ser. No. 301,787, Sep. 14, 1981, abandoned.

[51] Int. Cl.[3] ..... C10J 3/54

[52] U.S. Cl. ..... 48/197 R; 48/202; 48/210

[58] Field of Search ..... 48/197 R, 202, 210; 252/373; 44/1 R; 201/9

[56] References Cited

U.S. PATENT DOCUMENTS

| | | | |
|---|---|---|---|
| 3,615,299 | 10/1971 | Fischer et al. | 48/204 |
| 3,884,647 | 5/1975 | Nakaguchi | 44/72 |
| 3,970,434 | 7/1976 | Gasior et al. | 44/1 F |
| 4,057,402 | 11/1977 | Patel et al. | 48/197 R |
| 4,094,650 | 6/1978 | Koh et al. | 252/373 |
| 4,224,038 | 9/1980 | Misologites et al. | 44/1 SR |
| 4,234,319 | 11/1980 | Beeson | 44/1 R |
| 4,251,227 | 2/1981 | Othmer | 48/197 R |
| 4,304,571 | 12/1981 | McMahon | 44/1 SR |

FOREIGN PATENT DOCUMENTS

| | | | |
|---|---|---|---|
| 2757918 | 6/1979 | Fed. Rep. of Germany . | |
| 55-120690 | 9/1980 | Japan | 48/202 |

OTHER PUBLICATIONS

Kam et al., "The Oxidation of Bituminous Coal, 3 Effecton Coking Properties", Ind. Erg. Chem. Process Des. Dev., vol. 15, No. 3, 1976, pp. 416–422.

Crewe et al., "Decaking of Bituminous Coals by Alkaline Solutions", Fuel, vol. 54, Jan. 1975, pp. 20–23.

Euker et al., Catalytic Coal Gasification Process Development Unit Operation, 90th A.I.C.H.E. Meeting, Apr. 1981.

*Primary Examiner*—Peter F. Kratz

*Attorney, Agent, or Firm*—Michael F. Esposito

[57] ABSTRACT

Coal or similar carbonaceous solids impregnated with gasification catalyst constituents (16) are oxidized by contact with a gas containing between 2 volume percent and 21 volume percent oxygen at a temperature between 50° C. and 250° C. in an oxidation zone (24) and the resultant oxidized, catalyst impregnated solids are then gasified in a fluidized bed gasification zone (44) at an elevated pressure. The oxidation of the catalyst impregnated solids under these conditions insures that the bed density in the fluidized bed gasification zone will be relatively high even though the solids are gasified at elevated pressure and temperature.

11 Claims, 4 Drawing Figures

FLUIDIZED BED CATALYTIC COAL GASIFICATION PROCESS

The U.S. Government has rights in this invention pursuant to Contract No. ET-78-C-01-2777 between the Department of Energy and Exxon Research and Engineering Company.

This is a Continuation, of application Ser. No. 301,787, filed Sept. 14, 1981 and now abandoned.

BACKGROUND OF THE INVENTION

This invention relates to the gasification of coal and similar carbonaceous solids and is particularly concerned with a method for maintaining a relatively high gasifier bed density in a fluidized bed catalytic gasification process.

The formation of agglomerates is a problem frequently encountered in the gasification of caking coals. This is caused by plastic properties which develop when such coals are subjected to temperatures above their softening point. Upon reaching this point, generally between about 370° C. and about 480° C., the coal particles begin to swell and deform due to the formation of bubbles during devolatilization. As the temperature increases, deformation becomes more severe, the coal becomes plastic and sticky, and may eventually become fragile. The sticky particles tend to agglomerate and form coherent solid masses which reduce the gas permeability, and tend to block the reactor and the reactor feed lines.

Several methods have been devised to alleviate agglomeration problems encountered when caking bituminous coals are gasified. One such method proposed in the past is to pretreat the raw coal by contacting it with air at relatively high temperatures prior to passing the coal into the gasification reactor. Past studies have indicated that treatment of raw coal in such a fashion tends to destroy its caking properties and thereby prevents it from agglomerating during gasification. It has been noted that such pretreatment processes have pronounced disadvantages in that they are either expensive or result in the loss of valuable volatile constituents from coal and are therefore undesirable for use in a gasification process. Thus, in lieu of pretreating raw coal with air at high temperatures it has been suggested in the past that the coal be treated with aqueous sodium hydroxide or similar alkaline solutions in order to prevent agglomeration and swelling during gasification. Past studies have shown that raw coal treated with aqueous solutions of sodium hydroxide exhibits a free-swelling index in the range from about 1 to 2 and therefore is relatively non-caking.

Because of past teachings that sodium hydroxide and other alkali metal compounds tend to decake coal, it was felt that agglomeration would not be a problem in the catalytic gasification of caking coals if the catalyst was added to the raw coal prior to the introduction of the coal into the gasifier. Indeed, it has been found in the past that when coal is impregnated with alkali metal compounds and gasified in a fluidized bed at relatively low pressures, agglomeration problems are substantially obviated. It has now been surprisingly discovered, however, that when fluidized bed catalytic gasification is carried out at higher pressures, the density of the resultant fluidized bed of char particles is very low, in some instances as low as 80 kg/m$^3$. Such low bed densities result in a substantial reduction in the amount of coal that can be processed in a given gasifier and therefore substantially decrease the amount of product gas that can be produced in the process. In order to convert more coal into gas per unit of time, it would be necessary to utilize a much larger gasifier or to employ multiple gasifiers, procedures that would result in a substantial increase in the investment cost of a commercial plant and the resulting price of the product gas.

SUMMARY OF THE INVENTION

The present invention provides an improved fluidized bed catalytic coal gasification process which results in the maintenance of a relatively high fluidized bed density in the gasification reactor. In accordance with the invention, it has now been found that relatively high fluidized bed densities, normally densities above about 160 kg/m$^3$, can be maintained in a gasifier operating at elevated pressure and temperature by impregnating the carbonaceous feed solids with a catalyst and subsequently subjecting the impregnated solids to a mild oxidation prior to the gasification step. The carbonaceous feed solids are contacted with an aqueous solution containing water-soluble gasification catalyst constituents and the resultant catalyst impregnated solids are oxidized by contact with an oxygen-containing gas at a temperature below about 250° C. Normally, the catalyst constituents will comprise alkali metal constituents, preferably potassium constituents including potassium carbonate and potassium hydroxide. It has been surprisingly found that optimum fluidized bed densities are dependent upon the temperature at which the oxidation is carried out and on the concentration of oxygen in the oxygen-containing gas. Normally, the oxygen concentration will range between about 2.0 volume percent and about 21 volume percent, preferably between about 4.0 volume percent and about 15 volume percent; and the temperature will range between about 50° C. and about 250° C., preferably between about 125° C. and about 225° C. If a bituminous coal, such as Illinois No. 6 coal, is gasified at a pressure above about 0.7 MPa, it is important that the oxidation of the catalyst impregnated coal take place at a temperature between about 175° C. and about 225° C. when the oxygen concentration of the oxidizing gas is between about 4.0 volume percent and about 8.0 volume percent. If, on the other hand, the oxygen concentration is between about 8.0 volume percent and about 12.0 volume percent, it is important that the oxidizing temperature range between about 125° C. and about 175° C.

The invention is based in part upon the surprising discovery that bituminous coals impregnated with alkali metal catalyst constituents yield relatively low fluidized bed densities during gasification at elevated pressure as opposed to the relatively high densities that had been found in the past when gasification was carried out at relatively low pressures. Laboratory studies designed to predict bed density by measuring the swelling tendencies of coal under pressure indicate that coal impregnated with alkali metal catalyst constituents swell when subjected to rapidly increasing temperatures at the high pressures that are found in typical high pressure gasification reactors. These laboratory studies also show that the swelling tendencies are drastically reduced when the catalyst impregnated coal is oxidized by contacting it with an oxygen-containing gas. The studies further indicate that careful control of the oxygen concentration and the temperature during oxidation is necessary in order to obtain optimum bed densities when gasifying the catalyzed coal at high pressures in a pilot plant fluidized bed gasifier.

The process of the invention provides an efficient method for the fluidized bed catalytic gasification of bituminous coals and similar carbonaceous solids that tend to agglomerate and swell at elevated temperatures and high pressures which results in relatively high densities in the fluidized bed. As a result of the higher bed densities, more coal and product gas can be produced for a given size gasifier thus resulting in substantial savings especially when compared to the case where a larger gasifier or multiple gasifiers would be required in order to compensate for low bed densities.

DESCRIPTION OF THE PREFERRED EMBODIMENTS

Figure 1:
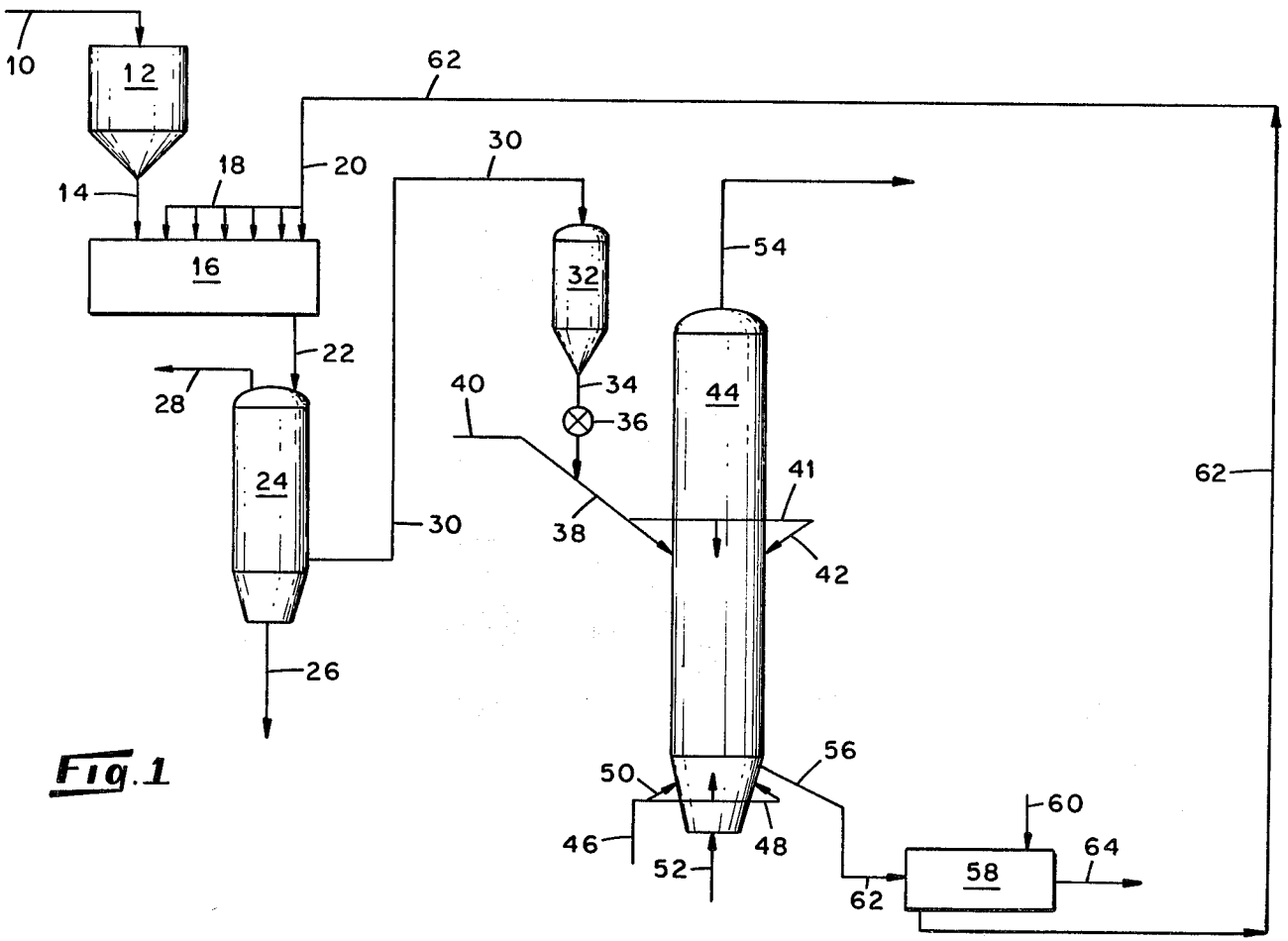
FIG. 1 in the drawing is a schematic flow diagram of a fluidized bed catalytic coal gasification process carried out in accordance with the invention.

The process depicted in FIG. 1 is one for the production of a substitute natural gas by the fluidized bed catalytic gasification of bituminous coal, subbituminous coal, lignite, liquefaction bottoms, oil shale or similar carbonaceous solids which contain volatilizable hydrocarbon constituents and may tend to swell and agglomerate at elevated temperatures. It will be understood that the invention is not restricted to this particular gasification process and instead may be employed in any fluidized bed gasification operation in which a catalyst is used to promote the reaction of oxygen, steam, hydrogen, carbon dioxide, or a similar gasification agent with solid carbonaceous feed material in a fluidized bed gasification reactor operated at elevated pressures.

In the process shown in FIG. 1, the solid carbonaceous feed material that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 12 from which they are passed through line 14 into catalyst impregnation zone 16. This zone contains a screw conveyor or similar device, not shown in the drawing, which transports the solids from one end of the zone to the other while they are being sprayed with a catalyst-containing solution supplied through line 20 and introduced into the zone through a series of spray nozzles or similar devices 18. The aqueous solution of water-soluble catalyst is recycled to line 20 through line 62 from the catalyst recovery portion of the process which is described in more detail hereinafter. Normally, sufficient catalyst-containing solution is passed into the impregnation zone to thoroughly wet the coal. The residence time of the coal in the catalyst impregnation zone is sufficient to allow the catalyst constituents in the solution to deposit onto and impregnate the coal or similar carbonaceous feed solids. In general, the solids exiting the catalyst impregnation zone will contain between about 5.0 and about 30 weight percent catalyst constituents, preferably between about 10 and about 20 weight percent. It will be understood that in lieu of a screw conveyor, the catalyst impregnation zone may be a ribbon mixer or any other device in which intimate contact between the feed solids and catalyst containing solution can be achieved In conventional catalytic gasification processes, the catalyst impregnated solids produced in zone 16 would be dried and passed into the gasifier. It has now surprisingly been found that when catalyst impregnated solids are gasified in a fluidized bed gasifier operated at a relatively high pressure, normally above about 0.35 MPa and preferably above about 0.7 MPa, the density of the fluidized bed is very low. This, in turn, results in the need for a larger gasifier in order to produce the desired quantities of product gas. It has now been found that the density of the fluidized bed in the gasifier can be substantially increased thereby obviating the need for a larger gasifier by contacting the solids after they have been impregnated with the catalyst constituents with an oxygen-containing gas at a temperature below about 250° C. but preferably above ambient temperature.

Referring again to FIG. 1, the catalyst impregnated solids are withdrawn from zone 16 and passed through line 22 into oxidizer or similar vessel 24, which contains a fluidized bed of carbonaceous solids extending upward within the vessel above an internal grid or similar distribution device not shown in the drawing. The carbonaceous solids are maintained in a fluidized state within the oxidizer by means of an oxygen-containing gas introduced into the oxidizer through bottom inlet line 26. The oxygen in the gas injected into the bottom of the oxidizer reacts with complex hydrocarbon molecules in the particles that comprise the fluidized bed to form carbon dioxide, carbon monoxide and molecules containing oxygen functional groups including carboxylic acid groups and ether linkages. The heat generated by these reactions serves to drive off the water in the wet solids entering the oxidizer thereby drying the particles before or during the oxidation process. Normally, the oxidizer will be operated at atmospheric pressure and at a temperature between about 50° C. and about 250° C., preferably between about 125° C. and about 225° C. The oxygen-containing gas injected into bottom inlet line 26 will normally have an oxygen concentration between about 2.0 volume percent and about 21 volume percent, preferably between about 4.0 volume percent and about 15 volume percent. Normally, the oxygen-containing gas wil be a mixture of air and recycle flue gas in which the oxygen concentration is controlled by the amount of recycle flue gas utilized. In general, the average residence time of the catalyst impregnated carbonaceous solids in the oxidizer will range between about 0.25 hours and about 20 hours, preferably between about 2 hours and about 8 hours.

The gas leaving the fluidized bed in oxidizer 24 passes through the upper section of the oxidizer, which serves as a disengagement zone where particles too heavy to be entrained by the gas leaving the vessel are returned to the bed. If desired, this disengagement zone may contain one or more cyclone separators or the like for the removal of relatively large particles from the gas. The gas withdrawn from the upper part of the oxidizer through line 28 will normally contain a mixture of carbon monoxide, carbon dioxide, water vapor, nitrogen, sulfur dioxide formed from the sulfur contained in the solids fed to the oxidizer and entrained fines. This hot flue gas is introduced into a cyclone separator or similar devices, not shown in the drawing, where the fine particulates are removed. The raw, hot flue gas from which the fines have been removed is withdrawn from the separator and can be passed to a waste heat boiler or other device where its heat can be utilized to generate steam or for some other purpose. A portion of the cooled flue gas is normally mixed with air to produce the oxygen-containing gas which is fed to the oxidizer through the bottom inlet line 26.

The oxidized, catalyst impregnated carbonaceous solids produced in oxidizer 24 are withdrawn through line 30 and passed to closed hopper or similar vessel 32 from which they are discharged through a star wheel feeder or equivalent device 36 in line 34 at an elevated pressure sufficient to permit their entrainment into a stream of high pressure steam, recycle product gas, inert gas or other carrier gas introduced into line 38 via line 40. The carrier gas and entrained solids are passed through line 38 into manifold 41 and fed from the manifold through lines 42 and nozzles, not shown in the drawing, into gasifier 44. In lieu of or in addition to hopper 32 and star wheel feeder 36, the feed system may employ parallel lock hoppers, pressurized hoppers, aerated standpipes operated in series, or other apparatus to raise the input feed solid stream to the required pressure level.

Gasifier 44 comprises a refractory lined vessel containing a fluidized bed of carbonaceous solids extending upward within the vessel above an internal grid or similar distribution device not shown in the drawing. The bed is maintained in the fluidized state by means of steam introduced through line 46, manifold 48 and peripherally spaced injection lines and nozzles 50, and by means of recycle hydrogen and carbon monoxide introduced through bottom inlet line 52. The particular injection system shown in the drawing is not critical, hence other methods for injecting the steam and hydrogen and carbon monoxide may be employed. In some instances, for example, it may be preferred to introduce both the steam and recycle gases through multiple nozzles to obtain a more uniform distribution of the injected fluid and reduce the possibility of channeling and related problems.

The injected steam reacts with carbon in the feed material in the fluidized bed in gasifier 44 at a temperature within the range between about 425° C. and about 870° C., preferably between about 600° C. and about 760° C., and at a pressure normally above 0.7 MPa. The pressure will normally range between about 1.4 MPa and about 4.9 MPa and will preferably be between about 2.8 MPa and about 4.2 MPa. When the catalyst constituents utilized to impregnate the carbonaceous feed material in impregnation zone 16 comprises alkali metal constituents, these constituents will interact at the gasification temperature with carbon in the carbonaceous solids to form a carbon-alkali metal catalyst, which will under proper conditions equilibrate the gas phase reactions occuring during gasification. Due to the gas phase equilibrium conditions existing in the bed as a result of the presence of the carbon-alkali metal catalyst and the recycle hydrogen and carbon monoxide injected near the lower end of the bed, the net reaction products will normally consist essentially of methane and carbon dioxide. Competing reactions that in the absence of catalyst and the hydrogen and carbon monoxide would ordinarily tend to produce additional hydrogen and carbon monoxide are suppressed. At the same time substantial quantities of exothermic heat are released as a result of the reaction of hydrogen with carbon monoxide and the reaction of carbon monoxide with steam. This exothermic heat tends to balance the endothermic heat consumed by the reaction of steam with carbon, thereby producing an overall thermoneutral reaction. So far as the heat of reaction is concerned, the gasifier is therefore largely in heat balance. The heat employed to preheat the feed solids to reaction temperature and compensate for heat loss from the gasifier is supplied for the most part by excess heat in the gases introduced in the gasifier through lines 50 and 52. Such a gasification system is described in detail in U.S. Pat. Nos. 4,094,650 and 4,198,204, the disclosures of which are hereby incorporated by reference. It will be understood that the process of the invention is not limited to this type of a gasification system and can be used with any type of gasification reactor in which a fluidized bed is maintained at elevated pressures. For example, the process of the invention may employ a catalytic gasifier in which oxygen is injected into the gasifier to burn a portion of the carbonaceous material in the fluidized bed to generate the heat required to maintain the reactor in heat balance.

The gas leaving the fluidized bed in gasifier 44 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 54 will normally contain methane, carbon dioxide, hydrogen, carbon monoxide, unreacted steam, hydrogen sulfide, ammonia, and other contaminants formed from the sulfur and nitrogen contained in the feed material, and entrained fines. This gas is introduced into a cyclone separator or similar device, not shown in the drawing, for removal of fine particulates. The resulting raw product gas may then be passed through suitable heat exchange equipment for the recovery of heat and then processed for the removal of acid gases. Once this has been accomplished, the remaining gas, consisting primarily of methane, hydrogen, and carbon monoxide, may be cryogenically separated into a product methane stream and a recycle stream of hydrogen and carbon monoxide which is returned to the gasifier through line 52. Conventional gas processing equipment can be used. Since a detailed description of this downstream gas processing portion of the process is not necessary for an understanding of the invention, it has been omitted.

In order to produce a reasonable amount of product methane in gasifier 44, it is necessary to maintain the fluidized bed in the gasifier at a density above about 160 $kg/m^3$. The density of the fluidized bed is controlled by the operating conditions in oxidizer 24. The catalyst impregnated carbonaceous solids fed to oxidizer 24 are preferably contacted with a gas containing between about 4 volume percent and about 15 volume percent oxygen at a temperature between about 125° C. and about 225° C. for a time from about 2 hours to about 8 hours. The actual temperature maintained in the oxidizer will depend at least in part upon the density of the fluidized bed desired in gasifier 44 and the oxygen concentration in the gas injected into the oxidizer through bottom inlet line 26. For example, if it is desired to maintain the density of the fluidized bed in the gasifier at a value above about 240 kg/m$^3$ and the gas injected into the oxidizer through line 26 contains about 5 volume percent oxygen, then the temperature in the oxidizer will normally be between about 175° C. and about 225° C. To maintain the same density in the gasifier utilizing a gas containing about 10 volume percent oxygen, the temperature in the oxidizer will normally be between about 125° C. and about 175° C. A residence time in the oxidizer above about 2 hours is normally sufficient to obtain the desired fluidized bed densities in gasifier 44.

It is not fully understood why higher pressures tend to yield lower bed densities when catalyst impregnated coal or similar carbonaceous solids are gasified. It is presently believed that higher gasification pressures tend to retard the vaporization of liquids from the particles comprising the fluidized bed and this in turn softens the particles and makes them more amenable to swelling by escaping gases. It is presently believed that oxidation of the catalyst impregnated particles prior to gasification causes condensation reactions to take place between oxygen functionalities of the lower molecular weight constituents thereby forming higher molecular weight constituents which do not liquefy at gasification conditions. It is felt that a reduction in the formation of liquids during gasification tends to decrease particle softening which in turn reduces the particle swelling and results in higher fluidized bed densities.

Referring again to FIG. 1, char particles containing carbonaceous material, ash and catalyst residues are continuously withdrawn through line 56 from the bottom of the fluidized bed in gasifier 44 in order to control the ash content of the system and to permit the recovery and recycle of catalyst constituents. The withdrawn solids are passed to catalyst recovery unit 58, which will normally comprise a multistage, countercurrent leaching system in which the char particles are countercurrently contacted with fresh water or some other aqueous solution introduced through line 60. If the catalyst utilized in impregnation zone 16 is comprised of alkali metal constituents, the first stage of the catalyst recovery unit may utilize calcium hydroxide digestion to convert water-insoluble catalyst constituents into water-soluble constituents. Such a digestion process is described in detail in U.S. Pat. No. 4,219,338, the disclosure of which is hereby incorporated by reference. An aqueous solution of water-soluble catalyst constituents is withdrawn from the recovery unit through line 62 and may be recycled through lines 20 and 18 to impregnation zone 16. Normally, the water-soluble catalyst constituents in the aqueous solution will comprise alkali metal constituents such as alkali metal carbonate, bicarbonate, hydroxide and similar alkali metal salts active in promoting the steam gasification of coal and similar carbonaceous solids. Preferably, the water-soluble catalyst will comprise potassium constituents. Particles from which substantially all the soluble catalyst constituents have been extracted are withdrawn from the catalyst recovery unit through line 64 and may be disposed of as landfill or used for other purposes.

In the embodiment of the invention shown in FIG. 1 and described above, carbonaceous solids impregnated with catalyst constituents are passed into oxidizer 24 where they are dried and oxidized. It will be understood that the process of the invention is not limited to the situation where the drying and oxidizing steps occur in the same vessel and is equally applicable to the situation where the wet impregnated solids from zone 16 are passed into a separate drying zone prior to introduction into oxidizer 24.

The nature and objects of the invention are further illustrated by the results of laboratory and pilot plant tests. The first series of tests illustrates that the laboratory swelling index for a bituminous coal impregnated with potassium hydroxide rises and then falls as pressure increases. The second series of tests illustrates that the laboratory swelling index can be maintained at a relatively constant value below 1.0 by oxidizing the potassium hydroxide impregnated coal prior to subjecting it to the swelling test. The third series of tests illustrates that the density of the fluidized bed in a pilot plant gasifier similar to the one depicted in FIG. 1 increases as the laboratory swelling index of the feed coal decreases. The fourth series of tests illustrates that the minimum laboratory swelling index and therefore maximum fluidized bed density is dependent upon the temperature of the oxidation and the concentration of oxygen in the oxidizing gas.

Figure 2:
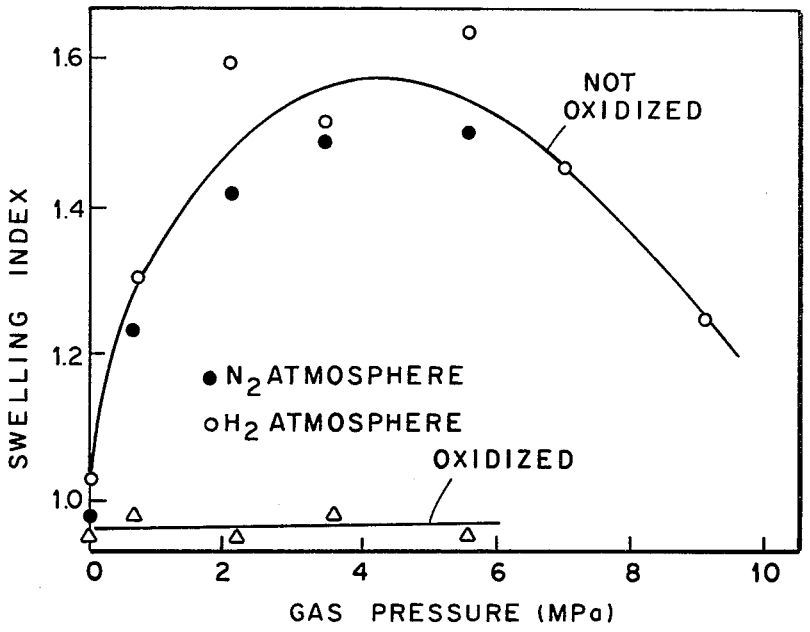
FIG. 2 is a plot illustrating that the laboratory swelling index of a bituminous coal impregnated with potassium hydroxide dramatically increases as pressure rises from atmospheric to about 4 MPa and that the swelling index can be maintained at a relatively constant value below 1.0 by oxidizing the impregnated coal.

In the first series of tests, 40 mg of Illinois No. 6 coal, a bituminous coal, sized between 30 and 50 mesh and impregnated with potassium hydroxide was placed in a quartz tube approximately 13.5 cm long and having an inside diameter of about 2 mm. The tube was then pressurized with either hydrogen or nitrogen to a predetermined value and the height of the impregnated coal in the tube was measured. The potassium hydroxide impregnated coal was then subjected to rapid heating at high temperature and at the predetermined pressure by placing the pressurized tube into a specially designed laboratory furnace maintained at a temperature of about 950° C. The tube was removed from the furnace after about 30 seconds and was allowed to cool. The height of the impregnated coal was then measured. The ratio of the height of coal in the tube after heating to the height before heating was then calculating and is referred to as the laboratory swelling index. The results of this series of tests is set forth in FIG. 2. As can be seen, the swelling index increases rapidly as the pressure increases up to about 4 MPa and then begins to decrease. This observed trend appears to be independent of the gaseous atmosphere in which the impregnated coal is heated. As will be seen hereinafter, swelling indexes above 1.05 are indicative of relatively low gasifier fluidized bed densities.

The second series of tests was conducted in the same general manner as discussed in relation to the first series of tests except the potassium hydroxide impregnated coal was mildly oxidized before samples were placed into the quartz tube and subjected to high temperatures at various predetermined pressures in a hydrogen atmosphere. The oxidation was conducted by placing about 200 grams of potassium hydroxide impregnated Illinois No. 6 coal in a bench scale fluidized bed oxidation unit operated at atmospheric pressure and at a temperature of about 200° C. The oxidizing gas, a mixture of nitrogen and air, contained about 6 volume percent oxygen and was passed upwardly through the impregnating coal particles for 6 hours at a superficial velocity of about 0.03 meters per second. The results of this series of tests are also set forth in FIG. 2. It can be seen from the figure that the swelling index of the oxidized, potassium hydroxide impregnated coal was less than 1.0 and remained relatively constant as the pressure increased. Since, as will be seen hereinafter, a swelling index below 1.0 is indicative of relatively high gasifier fluidized bed densities, these data show that oxidation of catalyst impregnated coal results in increasing gasifier fluidized bed densities.

The third series of tests was carried out in a pilot plant somewhat similar to the one depicted in FIG. 1. Illinois No. 6 coal was sprayed with an aqueous solution of potassium hydroxide, and the wet coal was passed through a series of screw dryers in which the impregnated coal was dried by indirect contact with steam. The dry coal was tthen passed into a fluidized bed oxidation vessel in which it was contacted with a mixture of nitrogen and oxygen. The vessel was steam jacketed in order to control the temperature during oxidation. The oxidized, potassium hydroxide impregnated coal was then passed into a fluidized bed gasifier in which it was contacted with a mixture of steam, hydrogen, and carbon monoxide at a temperature of about 700° C. and at a pressure of about 1.86 MPa. For each run the conditions in the oxidation vessel were recorded and the density of the fluidized bed in the gasifier was determined by measuring the pressure drop across pressure taps in the gasifier bed. A small sample of each batch of oxidized, catalyst impregnated coal fed to the gasifier was subjected to tests similar to those discussed in relation to the first and second series of tests except that the quartz tube was not pressurized to a predetermined pressure prior to being placed in the furnace. Instead, after the sample of oxidized, catalyst impregnated coal was placed in the tube, the end of the tube was sealed by heating it in a high temperature flame. When the quartz tube was then placed in the furnace, pressures above 3.5 MPa were generated in situ. After the quartz tube was removed from the furnace, the swelling index was determined as described in the first and second series of tests. The results of this series of tests are set forth in FIG. 3.

Figure 3:
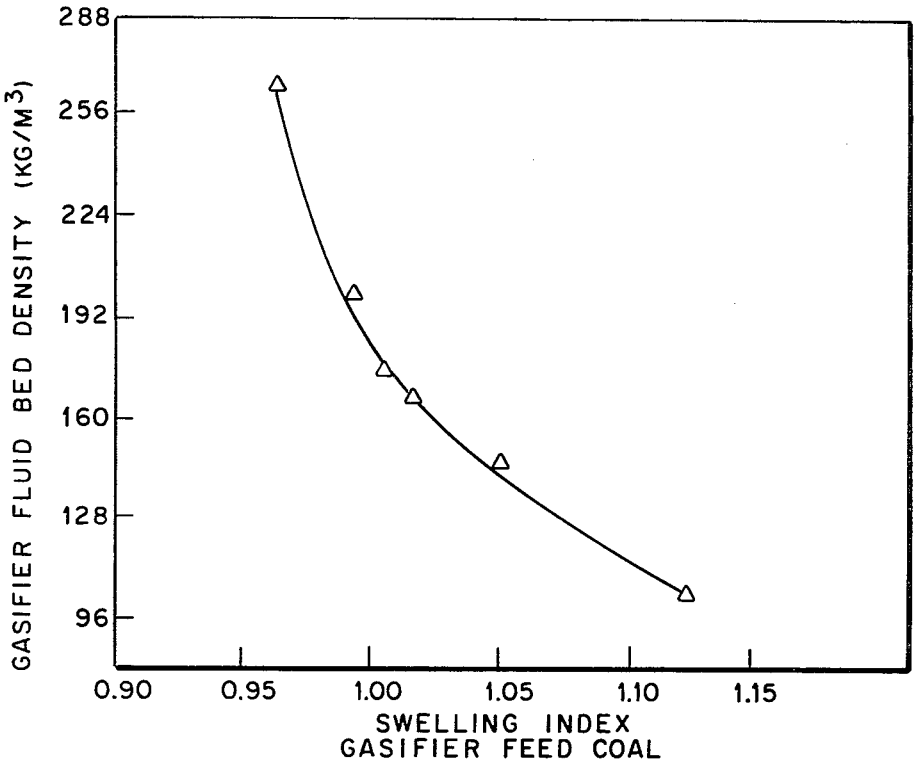
FIG. 3 is a plot indicating that the bed density in a fluidized bed gasification reactor fed with a bituminous coal impregnated with potassium hydroxide increases as the laboratory swelling index of the impregnated coal decreases.

As can be seen from FIG. 3, the swelling indexes of the various samples of oxidized, potassium hydroxide impregnated coal as determined by the laboratory technique appear to correlate well with the fluidized bed densities as measured in the pilot plant gasifier. As the swelling index increases, the fluidized bed density decreases. Although all the points plotted in the figure are for samples of potassium hydroxide impregnated coal that had been subjected to oxidation, the low fluidized bed densities observed in some of the runs are thought to be due to the fact that the pilot plant oxidation was ineffective for one reason or the other. Possible explanations for achieving ineffective oxidation include temperatures in the oxidation vessel that were either too high or too low and residence times that were too short or too long. It is clear from these data and the data in FIG. 4 that swelling index and bed density are very sensitive to oxidiation conditions. It was not possible to include a point in the FIG. 3 corresponding to a sample of potassium hydroxide impregnated coal that had not been oxidized, since in such situations problems were encountered in trying to feed the unoxidized coal through the high pressure feed lines into the gasifier. The dta set forth in FIG. 3 clearly show that the laboratory measured swelling index is indicative of the fluidized bed density that is obtained when subjecting catalyst impregnated coal to gasification at relatively high pressures.

The fourth series of tests illustrates that the conditions under which the catalyst impregnated coal is oxidized are critical in obtaining optimum swelling indexes and therefore maximum gasifier fluidized bed densities. In this series of tests, Illinois No. 6 coal was mixed with an aqueous solution of potassium hydroxide or potassium carbonate and the resultant slurry was placed in a vacuum oven and dried in a nitrogen atmosphere. Samples of the dried and catalyst impregnated coal were then oxidized in an atmospheric bench scale fluidized bed oxidation unit by fluidizing each sample with a mixture of nitrogen and oxygen at various temperatures and residence times. The oxygen concentration of the fluidizing gas was also varied. The swelling index of each sample of oxidized, catalyst impregnated coal was then measured in the same manner as discussed in relation to the third series of tests. The results of this series of tests are set forth in FIG. 4.

Figure 4:
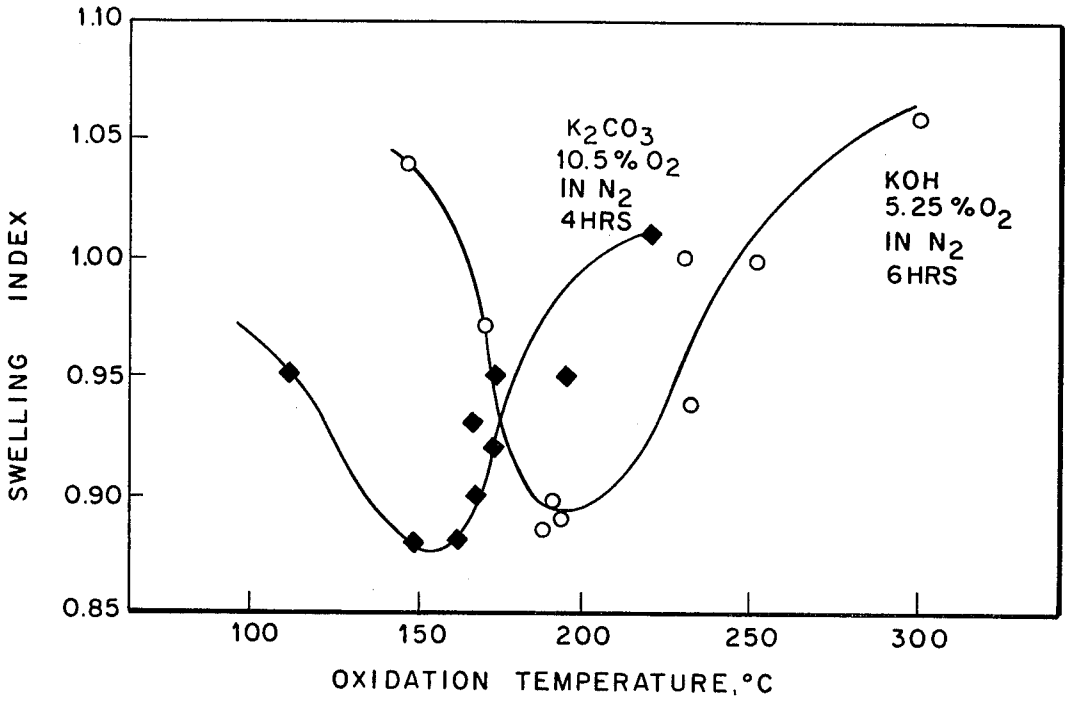
FIG. 4 is a plot illustrating that the laboratory swelling index of a bituminous coal impregnated with potassium catalyst constituents and then oxidized by contact with an oxygen-containing gas is dependent upon the temperature of the oxidation and the concentration of oxygen in the oxygen-containing gas.

As can be seen from FIG. 4, for a given oxygen concentration in the oxidizing gas, the laboratory swelling index decreases with rising temperature to a minimum and then increases as the temperature continues to rise. The temperature at which the minimum swelling index occurs appears to be dependent on the concentration of oxygen in the fluidizing gas. As can be seen from FIG. 3, low swelling indexes indicate high gasifier fluidized bed densities. Thus, for each particular concentration of oxygen, there appears to be a critical temperature range in which the swelling index reaches an optimum minimum value and therefore indicates a maximum fluidized bed density. The data in FIG. 4 indicate that for Illinois No. 6 bituminous coal, the critical temperature range for an oxygen concentration of 5.25 volume percent is between about 175° C. and about 225° C. and for an oxygen concentration of 10.5 volume percent is between about 125° C. and about 175° C.

It will be apparent from the foregoing that the invention provides a process which results in high fluidized bed densities when coal or similar carbonaceous materials impregnated with catalyst constituents are gasified at elevated pressures. As a result, the number and size of the gasifiers required to carry out the gasification are reduced thereby lowering the overall cost of the process.

We claim:

1. A process for the fluidized bed catalytic gasification of carbonaceous solids which tend to agglomerate and swell at elevated temperatures comprising:

(a) contacting said carbonaceous solids with an aqueous solution containing water-soluble alkali metal gasification catalyst constituents, thereby impregnating said carbonaceous solids with said alkali metal gasification catalyst constituents;

(b) oxidizing said catalyst impregnated carbonaceous solids by contacting said solids with an oxygen-containing gas in an oxidation zone at a temperature below about 250° C. such that dry oxidized catalyst impregnated carbonaceous solids are produced: and (c) gasifying said dry oxidized catalyst impregnated carbonaceous solids at an elevated pressure and temperature in a fluidized bed gasification zone, wherein the density of the fluidized bed in said gasification zone is maintained at a value above about 160 Kg/M$^3$ by controlling the oxidizing conditions in said oxidation zone.

2. A process according to claim 1 further characterized in that said carbonaceous solids comprise coal.

3. A process according to claim 1 further characterized in that said carbonaceous solids comprise bituminous coal.

4. A process according to claim 1 or 2 further characterized in that said water-soluble gasification catalyst constituents comprise potassium constituents.

5. A process according to claim 1 or 2 further characterized in that said oxidation zone comprises a fluidized bed reactor.

6. A process according to claim 1 or 2 further characterized in that said oxygen-containing gas contains between 2 volume percent and 21 volume percent oxygen and the temperature in said oxidation zone is between 50° C. and 250° C.

7. A process according to claim 1 or 2 further characterized in that said oxygen-containing gas contains between 4 volume percent and 15 volume percent oxygen and the temperature in said oxidation zone is between 125° C. and 225° C.

8. A process according to claim 1 or 2 further characterized in that said oxygen-containing gas contains between 4 volume percent and 8 volume percent oxygen and the temperature in said oxidizing zone is between 175° C. and 225° C.

9. A process according to claim 1 or 2 further characterized in that said oxygen-containing gas contains between 8 volume percent and 12 volume percent oxygen and the temperature in said oxidation zone is maintained between 125° C. and 175° C.

10. A process according to claim 1 or 2 further characterized in that the catalyst impregnated solids in step (a) are dried prior to their introduction into said oxidation zone.

11. A process according to claim 1 or 2 further characterized in that the residence time in said oxidation zone is between 0.25 hours and 20 hours.

* * * * *